US009357808B2

(12) United States Patent
Gray

(10) Patent No.: US 9,357,808 B2
(45) Date of Patent: Jun. 7, 2016

(54) U-FORM HAT BRACKET

(71) Applicant: Christopher James Gray, San Clemente, CA (US)

(72) Inventor: Christopher James Gray, San Clemente, CA (US)

( * ) Notice: Subject to any disclaimer, the term of this patent is extended or adjusted under 35 U.S.C. 154(b) by 0 days.

(21) Appl. No.: 14/469,003

(22) Filed: Aug. 26, 2014

(65) Prior Publication Data

US 2015/0129621 A1 May 14, 2015

Related U.S. Application Data

(60) Provisional application No. 61/904,016, filed on Nov. 14, 2013.

(51) Int. Cl.

| | |
|---|---|
| ***A42B 1/02*** | (2006.01) |
| ***A42C 3/00*** | (2006.01) |
| ***A42B 1/00*** | (2006.01) |

(52) U.S. Cl.

CPC .. *A42B 1/002* (2013.01); *A42C 3/00* (2013.01)

(58) Field of Classification Search

CPC ..... A42C 1/04; A42C 3/00; A42B 1/002; A42B 1/02

USPC ..... 2/175.4, 195.5; 223/12, 24, 84

See application file for complete search history.

(56) References Cited

U.S. PATENT DOCUMENTS

| | | | | |
|---|---|---|---|---|
| 1,275,023 | A * | 8/1918 | Hausinger | 2/181.4 |
| 2,426,339 | A * | 8/1947 | Boemanns | 2/182.1 |
| 2,505,403 | A * | 4/1950 | Jacobi | 2/175.4 |
| 2,651,045 | A * | 9/1953 | Shenkman | 2/175.4 |
| 2,740,567 | A | 4/1956 | Kaufman | |
| 5,481,760 | A | 1/1996 | Wood | |
| 5,725,134 | A | 3/1998 | Weltge | |
| 5,884,335 | A | 3/1999 | Whittaker | |
| 5,987,649 | A | 11/1999 | Robertson | |
| 6,523,728 | B2 | 2/2003 | Lee | |
| D637,356 | S * | 5/2011 | Green et al. | D29/122 |
| 7,958,570 | B1 * | 6/2011 | Mooney | 2/195.5 |
| 8,904,567 | B2 * | 12/2014 | Johnson et al. | 2/181.4 |

* cited by examiner

*Primary Examiner* — Ismael Izaguirre

(74) *Attorney, Agent, or Firm* — Daniel Boudwin; Global Intellectual Property Angency

(57) ABSTRACT

Disclosed is a cap shaping and forming insert device having a U-shaped structure that is placed in the front interior sweatband portion of a billed cap to prevent collapse and deformation thereof. The cap insert comprises a structure having at least two opposing vertically oriented arm members perpendicular to an elongated member disposed thereinbetween. The elongated member remains along the sweatband portion of the cap while the vertical arm members extend upward and into the interior crown of the cap. The cap insert is flexible and yet maintains a user-formed shape that can be used to maintain a desired shape of a billed cap once deployed therein. Moreover, a billed cap can be worn simultaneously with the cap insert therein. The cap insert can be washed and dried using standard methods while the cap insert is disposed therein in order to further preserve the structural integrity of the billed cap.

10 Claims, 3 Drawing Sheets

U-FORM HAT BRACKET

CROSS REFERENCE TO RELATED APPLICATION

This application claims the benefit of U.S. Provisional Application No. 61/904,016 filed on Nov. 14, 2013, entitled "U-Form Hat Bracket." The above identified patent application is herein incorporated by reference in its entirety to provide continuity of disclosure.

BACKGROUND OF THE INVENTION

1. Field of the Invention

The present invention relates to cap forming and shaping apparatuses. More specifically, the present invention pertains to a U-shaped cap shaping apparatus with substantial flexibility that is structured in such a way as to readily formed into a shape that can be inserted into a cap to support the contours and curvature thereof.

Billed caps also referred to as "baseball caps" in some settings are an integral part of causal everyday wear for many individuals. A billed cap is a type of hat apparatus having a dome shaped crown area that can readily conform to the head of the wearer wherein the back area of such caps can be adjustable via hook and loop fastening means or can be suited to fit the wearer's head. The majority of caps are made from soft fabric or cotton materials and can become collapsed and deformed in shape after washing and prolonged periods of use.

Conventional methods of shaping, forming and maintaining the structural integrity of billed caps come in a variety of forms and configurations. Some cap insert forming devices are used solely for maintaining the shape of cap while on retail display and are not adapted to remain in the cap while on the head of a wearer. Other devices can be placed in the interior crown of the cap covering much of the surface area therein while being worn simultaneously therewith, however this can be uncomfortable, unventilated and cause sweat to accumulate.

Other classes of cap shaping and forming devices can be substantially rigid and extend upward and cover a large area of the front interior area of a billed cap thus creating a rigid, boxed and unnatural appearance when worn. These cap insert devices do not provide much flexibility and a structure that is conducive for placement within a cap that coincides with the cap's contour and curvature.

Accordingly, the present invention relates to a new and improved cap shaping and forming device that can be inserted within the front interior portion of a cap and is disposed along the sweatband region of a billed cap to prevent the collapse and deformation thereof. Specifically, the present invention provides a U-shaped convex structure with at least two opposing vertically oriented arm members that are perpendicularly connected to a horizontal elongated member disposed thereinbetween forming a unitary body. The invention also provides a flexible body wherein the cap insert can be machine or hand washable and dried within a cap to maintain its structural integrity.

2. Description of the Prior Art

Devices have been disclosed in the prior art that relate to cap insert apparatuses for maintaining the structure and shape of a billed cap. These include devices that have been patented and published in patent application publications. These devices generally relate to cap insert apparatuses for shaping, maintaining and forming the structure of the dome shaped crown and front area of billed caps. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,987,649 to Robertson describes a cap insert device having an elongated flexible sheet that remains in a substantially planar configuration when in a relaxed state that includes a central portion, opposing tapered portions and opposing leg portions wherein the device can be inserted within a billed cap in the sweatband area thus forming the cap into its proper shape. This device however, does not provide for a cap insert that utilizes a U-shaped apparatus that is conducive to the shape and curvature of a billed cap.

U.S. Pat. No. 5,481,760 to Wood discloses a cap shaping apparatus for maintaining the shape of the front portion located above the bill of a baseball type of cap wherein the device is formed from a flat, planar shaped and relatively stiff material that allows some flexibility to adapt to the curvature of the band of a cap or the like. The device is inserted into the band of a cap, between the band and the top portion of the cap material where it extends in an upward direction and into the front of the cap to prevent the collapse or deformation of the cap. The present invention however, provides a cap shaping apparatus with much flexibility in order to conform to a user-defined shape prior to being placed within a cap, whereby the hat conforms to the shape of the apparatus while deployed therein.

U.S. Pat. No. 6,523,728 to Lee describes a baseball type cap insert that is sufficiently rigid and adapted to support the hemispherical crown portion of a billed cap against collapsing and crushing during shipping and packaging. While the rigid property of the device provides a useful function that is proper for the nature of transporting and packaging caps, it offers little utility in the everyday wear and use of a billed cap wherein the cap is placed on the head of the wearer.

U.S. Pat. No. 2,740,567 to Jacob allows for a cap support device for use with baseball caps to hold them in shape during the process of shipment and storage wherein the structure of the device is that of a half dome shape in order to conform to the hemispherical shape of one-half of the cap. A drawback to the function of this device is that the cap cannot be properly worn on the head of a wearer while the device remains therein. The present invention offers a cap forming and shaping device that can be inserted within the sweatband area of a billed cap and worn in the head in conjunction therewith.

U.S. Pat. No. 5,884,335 to Whittaker relates to a shape retainer support assembly for use with a baseball type cap with a flexible body that can be affixed to the interior of the crown portion of the cap that includes several prongs that project downwardly and outwardly therefrom. The arms of the device can be positioned between the inner surface of the crown and the sweatband of the cap. This device, while helpful for retaining the shape of the crown portion of a cap, is not quite helpful for retaining the shape of the front portion of the cap, specifically the horizontal sweatband region of the cap.

U.S. Pat. No. 5,725,134 to Weltge discloses a supporting device for preserving the shape and integrity of a cap wherein the device is formed as a block of compressible, resilient material shape having sufficient rigidity that is shaped to conform to the interior area of a cap for the purpose of retail or collection display in addition to transportation. The present invention can be used for maintaining the structural integrity of a cap for retail display, transportation, washing and drying and for instances where the cap is worn on the head.

These prior art devices have several known drawbacks. The above discussed cap shaping and retaining support assemblies do not provide a flexible cap forming apparatus that provides a U-shaped structure wherein the device is structured in such a way as to form a slight convex shape in order to further facilitate the inherent shape of common billed caps and includes two opposing arm members that can support and shape the cap to which is inserted therein.

It is submitted that the present invention substantially diverges in design elements from the prior art and consequently it is clear that there is a need in the art for an improvement to existing cap shaping and forming devices. In this regard the instant invention substantially fulfills these needs.

SUMMARY OF THE INVENTION

In view of the foregoing disadvantages inherent in the known types of cap forming and maintaining devices now present in the prior art, the present invention provides a new cap forming, shaping and maintaining apparatus wherein the same can be utilized for providing convenience for the user when washing, drying or wearing a billed cap.

It is therefore an object of the present invention to provide a new and improved cap forming, shaping and maintaining insert device that has all of the advantages of the prior art and none of the disadvantages.

It is another object of the present invention to provide a cap shaping and forming device to maintain the desired shape and structural integrity of a billed cap.

Another object of the present invention is to provide a cap shaping and forming device that is designed in a way that is U-shaped and is conducive to being formed into a desired shape by a user prior to insertion into a billed cap.

Another object of the present invention is to provide a cap shaping and forming device that can facilitate ventilation under the cap and between the user's head and the cap.

Another object of the present invention is to provide a cap shaping and forming device that is readily formable into a convex structure.

Another object of the present invention is to provide a cap shaping and forming device that can be placed behind the sweatband region of the billed cap to prevent collapse and deformation thereof.

Yet another object of the present invention is to provide a cap shaping and forming device that is flexible to support hand-forming operations, yet sufficiently stiff that the device maintains its shape once formed.

Yet another object of the present invention is to provide a cap shaping and forming device having at least two arm members.

Another object of the present invention is to provide a cap shaping and forming device that can be used during washing and drying of the billed cap to maintain its structure and shape.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
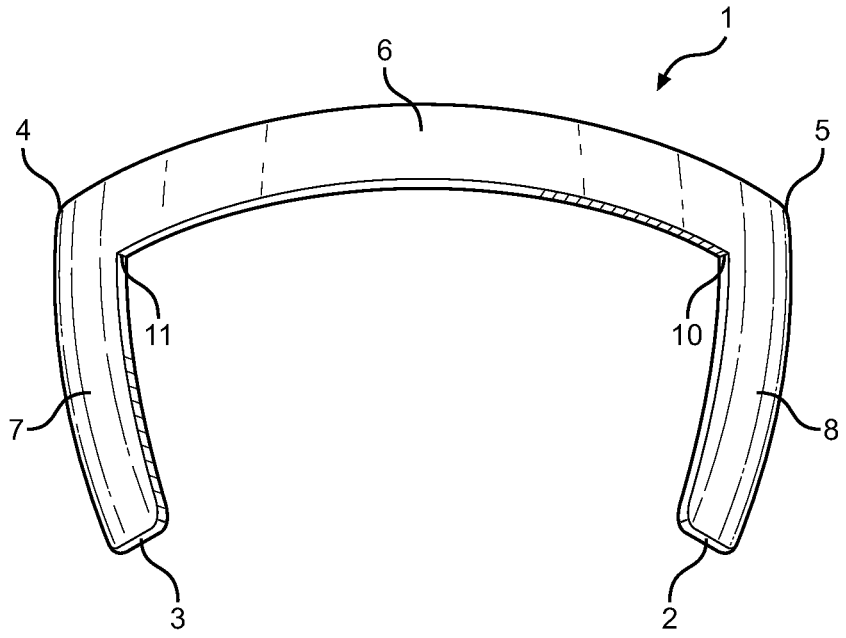
FIG. 1 shows a front view of the cap shaping and forming insert apparatus having a U-shaped structure that includes a vertical left arm member and a vertical right arm member opposing one another and perpendicularly connected to a horizontal elongated member.

Reference is made herein to the attached drawings. Like reference numerals are used throughout the drawings to depict like or similar elements of the cap shaping and forming insert device. For the purposes of presenting a brief and clear description of the present invention, the preferred embodiment will be discussed as used for shaping, forming and maintaining the structural integrity of a billed cap wherein the cap shaping and forming insert device can be placed within the front interior portion of a billed cap along the sweatband region of the cap therein in order to prevent collapse and deformation of the cap. The figures are intended for representative purposes only and should not be considered to be limiting in any respect.

Referring now to FIG. 1, there is shown a front view of the cap, shaping, forming and maintaining insert structure 1 described herein as "the cap insert structure" or "cap shaping and forming insert structure." The cap shaping and forming insert structure 1 comprises a U-shaped structure having opposing arm members that include a vertical left arm member 7 and a vertical right arm member 8 that is perpendicularly connected to a horizontal elongated member 6 wherein the left and right arm members 7, 8 and the horizontal member 6 form one unitary body. The left arm member 7 forms a top edge 3, a base end, an exterior edge and an interior edge and the right arm member 8 forms a top edge 2, a base end, an exterior edge and an interior edge wherein the base end of both the left and right arm members 7, 8 have corners 4, 5 that can be pointed or rounded in structure wherein any other suitable structure can be substituted therein.

The top edge 3 of the left arm member 7 and the top edge 2 of the right arm member 2 can be straight or curved in shape wherein any other suitable structure can be substituted therein. The left arm member 7 terminates upon reaching the horizontal elongated member 6 thus forming the bottom end of the left arm member 7 wherein the left arm member 7 becomes integral with the horizontal elongated member 6 forming a unitary structure. The right arm member 8 terminates upon reaching the horizontal member 6 thus forming the bottom end of the right arm member 8 wherein the right arm member 8 becomes integral with the horizontal elongated member 6 forming a unitary structure. The bottom end of the left arm member 7 and the bottom end of the right arm member 8 forms a corner 4, 5 wherein the corner 4, 5 can be pointed or rounded in shape or any other suitable shape.

Figure 2:
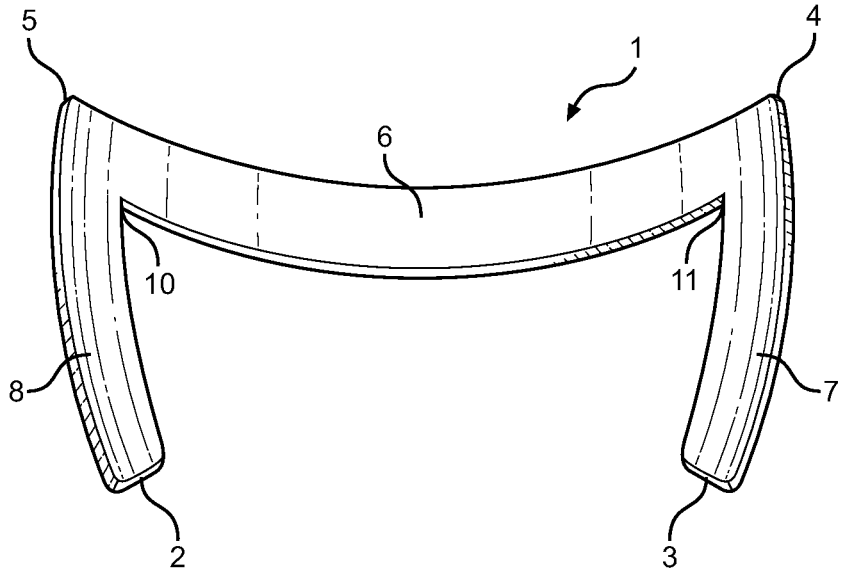
FIG. 2 shows a back view of the cap shaping and forming insert apparatus having a U-shaped structure that includes a vertical left arm member and a vertical right arm member opposing one another and connected perpendicularly connected to a horizontal elongated member.

Referring now to FIG. 2 there is shown a back view of the cap shaping and forming insert structure comprising a vertical left arm member 7, vertical right arm member 8 and a horizontal elongated member 6 having no discernible separation thereinbetween thus forming one whole and unitary body. The cap shaping and forming insert structure 1 is substantially planar in configuration in a preferred embodiment, however it can be tubular, three dimensional, padded and any other suitable thickness, width or length. The cap shaping and forming structure 1 can be curved wherein the front of the cap insert structure bends in a backward direction forming a slightly arcuate or convex shape. The convex shape of the cap insert structure 1 allows it to fit more readily therein the interior portion of a billed cap wherein the cap insert structure 1 can conform to the inherent contours and curvature of a billed cap.

The left arm member 7 and the right arm member 8 of the cap insert structure 1 have an exterior edge and an interior edge and the horizontal elongated member 6 has an exterior edge and an interior edge wherein the interior edge of the bottom end of the left arm member 7 and the interior edge of the horizontal elongated member 6 forms a left interior corner 11. Similarly, the interior edge of the bottom end of the right arm member 8 and the interior edge of the horizontal elongated member 6 form a right interior corner 10. The cap insert structure as described is not limited to a left arm member 7 and a right arm member 8 and can have at least two arm members and further provide additional arm members.

Figure 3:
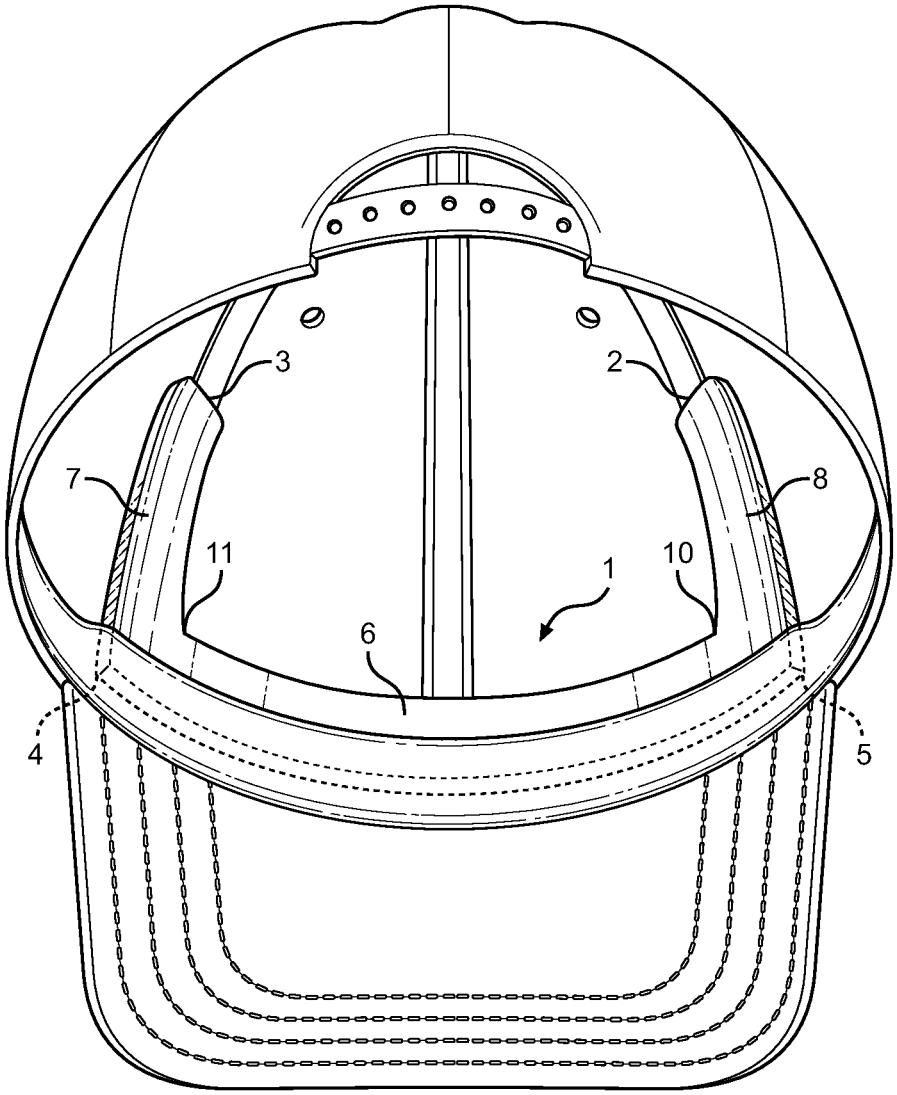
FIG. 3 shows a view of the cap shaping and forming insert apparatus placed in the interior front portion of a billed cap along the sweatband region of the cap therein wherein the vertical arm members extend upward along the front interior area of the cap.

Referring now to FIG. 3 there is shown a view of the cap shaping and forming insert structure 1 placed within the front interior area of a billed cap wherein the cap insert structure 1 can be disposed along the sweatband region of a billed cap. The cap insert structure 1 enables a user to maintain the shape, form and structural integrity of a billed cap wherein the cap insert structure 1 is considerably flexible and lightweight and can remain within the front interior cap area while on the head of the user. The cap insert structure 1 can be made from an aluminum material in a preferred embodiment, however it can be made from cotton, plastic, nylon, rubber, porous and ventilated materials and any other suitable material wherein the materials can be waterproof, machine washable, heat resistant, water resistant, sweat resistant and can include antimicrobial properties embedded therein. The material is one that is adapted to be sufficiently flexible such that a user can hand-form a desired shape for the structure, yet sufficiently stiff that after the hand-forming operation the structure retains the desired shape. The material is flexible but retains a shape once formed into a desired curvature for a specific hat. The user can place the cap insert into the front interior area of a billed cap along the sweatband region thereof wherein the horizontal elongated member 6 can rest thereinbetween the sweatband region and the front interior surface of a billed cap. The cap insert structure 1 can conform to the dome-shaped crown of a billed cap therein without the use of adhesives in a preferred embodiment or can be affixed therein via an adhesive, glue, hook and loop fastening means or any other suitable fastening means.

The cap insert structure 1 can be placed within the front interior area of a billed cap or other cap wherein the user can place the cap with the cap insert structure 1 therein into a washing machine in order to prevent the billed cap from becoming deformed and collapsed while being washed. The user can place the billed cap and cap insert structure 1 from the washing machine forthwith into a dryer thereby forming and preserving the structural integrity of the cap during the washing and drying process.

Figure 4:
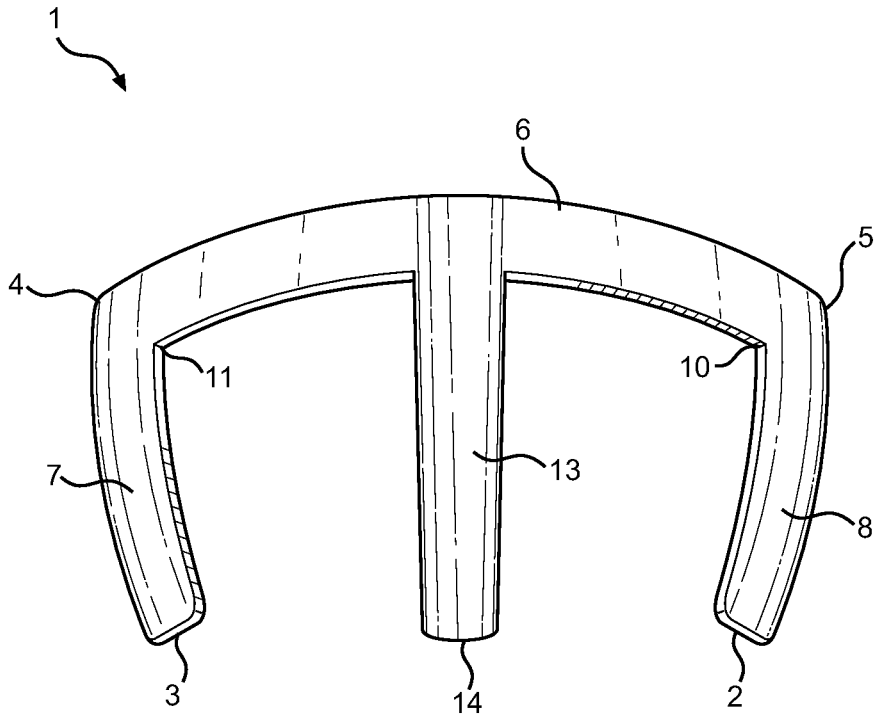
FIG. 4 shows an alternative embodiment view of the cap shaping and forming insert apparatus having a U-shaped structure that includes a vertical left arm member, a vertical central arm member and a vertical right arm member perpendicularly connected to a horizontal elongated member.

Referring now to FIG. 4 there is shown an alternative embodiment view of the cap shaping and forming insert apparatus 1 having a U-shaped structure that includes at least two vertical arm members comprising a vertical left arm member 7, a vertical central arm member 13 and a vertical right arm member 8 in an opposing relationship to one another and perpendicularly connected to a horizontal elongated member 6. The vertical central arm member 13 forms a top edge 14, side edges and a bottom end. The vertical central arm member 13 terminates upon reaching the horizontal elongated member 6 thus forming the bottom end of the vertical central arm member 13 wherein the vertical central arm member 13 becomes integral with the horizontal elongated member 6 forming a unitary structure. The vertical central arm member 13 is located in between the vertical right arm member 8 and the vertical left arm member 7 and is thus in an opposing relationship therewith the vertical left arm member 7 and the vertical right arm member 8. The vertical central arm member 13 is perpendicularly connected to the horizontal elongated member 6 and forms one unitary body therewith. The top edge 14 of the vertical central arm member 13 can be straight or curved in shape wherein any other suitable structure can be substituted therein.

The user can place the cap shaping and forming insert apparatus 1 into the front interior area of a billed cap along the sweatband region thereof wherein the horizontal elongated member 6 can rest thereinbetween the sweatband region and the front interior surface of a billed cap and the vertical central arm member 13 can extend upward into the front interior and central portion of a billed cap. Thus, the cap insert structure 1 can further maintain the shape and structure of the cap along the interior front and central area of the cap and along the interior front and side areas thereof.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cap insert structure comprising:

at least two arm members comprising at least a left arm member and a right arm member;

said left arm member having a substantially upstanding orientation;

said left arm member having a top, a bottom, and an outer terminal edge on a side of said left arm member opposing said right arm member;

said right arm member having a substantially upstanding orientation;

said right arm member having a top, a bottom, and an outer terminal edge on a side of said right arm member opposing said left arm member;

an elongated member having an upper edge and a lower terminal edge, said upper edge of said elongated member being connected substantially perpendicularly to said bottom of said left arm member and perpendicularly connected to said bottom of said right arm member;

said elongated member being horizontally disposed between said left arm member and said right arm member forming one unitary bodying having a substantial U-shape;

said unitary body comprising a flexible material, wherein said unitary body can be hand-formed into a desired shape, and wherein said unitary body maintains the desired shape after being hand-formed;

and wherein said outer terminal edge of either one of said right arm or said left arm member terminates at said lower terminal edge of said elongated member such that a ninety degree angle is formed.

2. The cap insert structure of claim 1, wherein said left arm member and said right arm member are substantially vertically oriented with respect to said elongated member.

3. The cap insert structure of claim 1, wherein said elongated member further comprises an arcuate shape.

4. The cap insert structure of claim 1, wherein said flexible material is washing machine compatible.

5. The cap insert structure of claim 1, wherein said flexible material is dryer compatible.

6. The cap insert structure of claim 1, wherein said at least two arm members further comprise:

one or more central arm members having a top and a bottom and side edges;

said one or more central arm members being connected substantially perpendicularly to said elongated member and forming a unitary body;

said one or more central arm members being located in between said left arm member and said right arm member.

7. The cap insert structure of claim 1, wherein said lower terminal edge of either one of said right arm or said left arm terminates at a common point with said lower terminal edge of said elongated member.

8. A cap insert structure comprising:

three arm members comprising a center arm member, a left arm member, and a right arm member;

said left arm member having a substantially upstanding orientation;

said left arm member having a top and a bottom;

said right arm member having a substantially upstanding orientation;

said right arm member having a top and a bottom;

said center arm member having a substantially upstanding orientation;

said center arm member having a top and a bottom;

an elongated member being connected substantially perpendicularly each of said bottom of said center arm member, left arm member, and said right arm member;

said center member being disposed between said left arm member and said right arm member;

said unitary body comprising a flexible material that can be hand-formed into a desired shape, wherein said unitary body maintains the desired shape after being hand-formed.

9. The cap insert structure of claim 8, wherein said left arm member and said right arm member are each equidistant from said center arm member.

10. The cap insert structure of claim 8, wherein each of said right arm member and said left arm member further comprise an outer terminal edge, said elongated member comprising an upper edge and a lower terminal edge, wherein each of said right arm member and said left arm member are connected to an upper edge of said elongated member, and wherein each of the outer terminal edges of the right arm and left arm member form a substantially ninety degree angle with respect to said lower terminal edge of said elongated member.

* * * * *